US006505903B2

(12) United States Patent
Ishinaga et al.

(10) Patent No.: US 6,505,903 B2
(45) Date of Patent: Jan. 14, 2003

(54) METHOD OF DISCHARGING PLURAL LIQUID DROPLETS FROM SINGLE DISCHARGE PORT

(75) Inventors: Hiroyuki Ishinaga, Tokyo (JP); Sadayuki Sugama, Ibaraki (JP); Yoshinori Misumi, Tokyo (JP); Yoichi Taneya, Kanagawa (JP); Hiroyuki Sugiyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/911,454

(22) Filed: Jul. 25, 2001

(65) Prior Publication Data

US 2002/0024566 A1 Feb. 28, 2002

(30) Foreign Application Priority Data

Jul. 27, 2000 (JP) ..... 2000-227980

(51) Int. Cl.[7] ..... B41J 29/38; B41J 2/05
(52) U.S. Cl. ..... 347/11; 347/65
(58) Field of Search ..... 347/11, 15, 63, 347/65, 57–59

(56) References Cited

U.S. PATENT DOCUMENTS 4,686,539 A * 8/1987 Schmidle et al. ..... 347/11
4,723,129 A 2/1988 Endo et al. ..... 347/56
5,600,349 A * 2/1997 Keefe ..... 347/11
6,116,716 A 9/2000 Tajika et al. ..... 347/19

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

Liquid is discharged at a high frequency in a consecutive manner with a liquid discharge head having a movable member. A bubble formed for discharge a first discharged droplet grows large into a discharge port side by the movable substantially closing a common liquid chamber side in a bubble forming procedure, and disappears fast at the common liquid chamber side by the movable member releasing the common liquid chamber side of a flow path in a bubble disappearance procedure, and reaches a state to remain at the discharge port side of a heat-generating body. Under this state, since the bubble disappears at the common liquid chamber side, a constant liquid is refilled to reach the discharge port side, and the bubble does not yet completely disappear, a meniscus is disposed comparatively closer to a liquid discharge face. Under the circumstances, if discharge of a second discharged droplet is arranged to start from this state, the liquid can be discharged well at a short interval in a consecutive manner.

11 Claims, 9 Drawing Sheets

METHOD OF DISCHARGING PLURAL LIQUID DROPLETS FROM SINGLE DISCHARGE PORT

BACKGROUND OF THE INVENTION

1. Field of the Invention

The present invention relates to a method for discharging liquid, a method to discharge desired liquid by generating bubbles by applying thermal energy to liquid, liquid discharge head and liquid discharge device, and in particular relates to a method for discharging liquid using a movable member that is displaced by generation of bubbles.

In addition, the present invention is applicable to an apparatus such as a printer to execute recording on a recording medium to be recorded, such as paper, thread, fiber, fabric, leather, metal, plastic, glass, lumber, ceramics, a photocopier, a facsimile having transmission system, and a word processor having a printer part and the like and moreover to an industrial recording apparatus mixed in a complex fashion with various processing devices.

Incidentally, the term "recording" in the present invention means not only to form images having intelligence such as letters and drawings etc. to a recording medium to be recorded but also means to form images not having intelligence such as patterns etc.

2. Related Background Art

Liquid jet recording method, or so-called bubble jet recording method, that gives energy such as heat to ink (liquid) to cause liquid to undergo status change accompanying precipitous volume change (generation of bubbles) and discharges liquid from a discharge port with application force based on this status change, causes the liquid to attach onto a recording medium to be recorded, and proceeds with image forming, is conventionally known. For a recording apparatus using this bubble jet recording method, as disclosed in the U.S. Pat. No. 4,723,129 publication etc., a discharge port to discharge liquid, a liquid flow path to communicate with this discharge port, and an electro-heat converter as energy generating means for discharging liquid disposed inside the liquid flow path are generally provided.

Such a recording method enables recording of high density images at a high speed and with low noise, and can dispose the discharge port to discharge liquid at a high density in the head to execute this recording method, and therefore has a lot of excellent advantages so as to easily obtain recorded images and moreover color images as well with high resolution with a small apparatus. Therefore, this bubble jet recording method has recently been utilized for a lot of office apparatus such as a printer, a photocopier and a facsimile etc. and moreover has become utilized even for systems for industrial use such as a textile printing apparatus etc.

A schematic section view around an electro-heat converter of liquid discharge head of a prior art example to execute recording by such a recording method is shown in FIG. 10. In the example shown in the above-described drawing, the electro-heat converter is constructed of a resistant layer 100 and electrodes 101*a* and 101*b* laminated thereon and formed as a pair having a gap. That is, the heat generating part 105 to generate heat by applying voltages is formed between the electrode 101*a* and the electrode 101*b*, and this part will become a bubble generation region where bubbles are formed by film boiling. In addition, above the resistant layer 100 and the electrodes 101*a* and 101*b*, two protection layers 102 and 103 protecting these are formed.

The discharge port to discharge liquid by generating a bubble 104 with heat generation at the heat-generating body 105 is disposed at a position facing the heat-generating body 105 such as the discharge port S (so-called side shooter type) or is disposed at the side direction such as the discharge port E (so-called edge shooter type). In any case, in the liquid discharge head with such construction, the bubble 104 grows comparatively large toward the liquid chamber side X with comparatively small flow path resistant, and therefore the bubble disappearance position 106 is likely to come to the center area of the heat-generating body 105 or a little bit biased to the direction of the liquid chamber side.

Thus, in the liquid discharge head as shown in FIG. 10, accompanied by growth of the bubble 104, the liquid is largely pushed back to the direction of the chamber side X. Accordingly, a meniscus, that is formed in the discharge port side, being the surface between the liquid and the outside atmosphere, retreats comparatively fast accompanied by bubble disappearance after liquid discharge, and vibrates comparatively long. In addition, in the bubble disappearance steps, a flow of liquid toward the heat-generating body 105 from the liquid chamber side and a flow of liquid toward the heat-generating body 105 from the discharge port reach approximately the same level, and thus the timing when refilling of liquid to the discharge port side substantially commences comes after the flow of liquid from the discharge port side approximately stops and proceeds comparatively late, and therefore it takes a comparatively long time until the meniscus comes back to the normal position to be stabilized. Thus, in the case where liquid is discharged in a consecutive fashion, it is necessary to take a time interval comparatively long for discharge and there is a limit for a drive frequency that can enable liquid to be discharged properly.

In addition, as a liquid discharge head, one is known that has a construction that includes a movable member provided in the bubble generating region to undergo displacement and accompanied by growth of bubbles and a controller to control the displacement of the movable member within a desired range. The controller faces the bubble generating region of the liquid flow path so that substantial contact between the movable member having undergone displacement and the controller constitutes a substantially closed space except the discharge port. In this liquid discharge head, at the time of growth of bubbles, displacement of the movable member takes place to substantially close the upper stream side flow path of the bubble generation region. The liquid to be pushed back to the upstream side at the time of growth of bubbles is comparatively small. In addition, at the time of bubble disappearance, the movable member undergoes displacement so as to make the flow resistance at the upstream side small, and bubble disappearance at the upstream side of the bubble generation region is promoted to occur ahead than at the downstream side. Therefore, the retreat quantity of the meniscus is small and refill of liquid is executed efficiently.

In addition, in the liquid discharge head, the gas having melted into the liquid is released at the time when bubbles are formed, giving rise to a case where microbubbles are formed and remain behind. Under this circumstance, so that a quantity of these microbubbles does not remain to cause trouble, the liquid in the vicinity of the discharge port is sucked out and a recovery operation such as removal of microbubbles is executed on a regular basis. On the other hand, in the liquid discharge head comprising the movable member, the liquid is never pushed back to the upstream side, and therefore the microbubbles are released from the discharge port before increasing in number enough to cause trouble in the discharge operation, and hardly remain behind. Therefore, over a comparatively long period, consecutive recording can be executed and, at maximum, it is possible to execute recording of 100 sheets or more in a consecutive manner.

As described above, the liquid discharge head including a movable member has an advantage that it can execute refilling of liquid swiftly without giving rise to considerable retreat of the meniscus, and therefore uses a comparatively short time interval. Discharge of liquid can be executed, and driving with a comparatively high frequency is possible.

In addition, conventionally, in order to arrange for driving at a higher frequency, it is considered to be practically effective to cause the bubbles formed due to the aforesaid discharge to undergo bubble disappearance fast to arrange to execute the next discharge. The reasons therefor are that in order to execute the next discharge properly, it is generally necessary to execute the next discharge after the meniscus comes back to the normal position via vibration steps to complete refilling stably, and that the completion of this refilling and the recovery and stability of the meniscus occurs at the end of bubble disappearance.

However, in order to complete bubble disappearance, a constant time period is theoretically required as well, and this time period will end to provide a limit to the driving interval. That is, in applying voltage pulses with several $\mu$S widths in order to execute liquid discharge, the period for the bubble generation, their growth and disappearance can be made to be 30 to 50 $\mu$S from the commencement of the pulse application is consideration of delay in response. Under these circumstances, even if the next pulse has been applied immediately after bubble disappearance to execute next discharge, the driving frequency is limited to 20 to 30 kHz. Under the circumstances, the present inventors thought that there would be no progress in technology without breaking through such a situation.

That is, an objective of the present invention is to break through the limit of the prior art related to execution of liquid discharge at higher frequency, and the present invention proposes a novel method for discharging liquid that can discharge liquid in a continuous fashion at a higher frequency.

SUMMARY OF THE INVENTION

A method for discharging liquid according to the present invention is a method for discharging liquid, in which a plurality of discharged liquid droplets are discharged from a same discharge port using a liquid discharge head. The liquid discharge head includes: a heat-generating body to generate thermal energy for generating bubbles in a liquid; a discharge port as a part to discharge the liquid; a liquid flow path communicating with the discharge port and having a bubble generation region to generate bubbles in the liquid; a liquid chamber to supply the liquid flow path with the liquid; a movable member provided in the bubble generation region to be displaced by growth of the bubbles; and a controller to control the displacement of movable member within a desired range. The heat-generating body and the discharge port are in a linearly communicating state so that the liquid is discharged from the discharge port with energy at the bubble generation, the controller being provided to face the bubble generation region of the liquid flow path, and a liquid flow path having the bubble generation region constituting a substantially closed space except the discharge port by substantial contact between the displaced movable member and the controller, in which after commencement of disappearance of the bubbles formed by preceding liquid discharge, and under a state that the bubbles remain biased at the discharge port side in the bubble generation region and a portion where the bubbles do not exist is given rise to at the liquid chamber side of the bubble generation region, the liquid is caused to bubble by supplying the heat-generating body with driving energy for succeeding liquid discharge.

The present invention is not driven for the next discharge after the end of disappearance of a bubble formed at the time of the preceding liquid discharge, but is to execute discharge continuously at a timing by taking the balance between the succeeding bubble formation for discharge and the discharge, utilizing bubbles formed by the preceding liquid discharge, which is an epoch-making invention.

Paying attention to a movable member giving the above described efficient refilling characteristics, and in a liquid discharge head comprising the movable member. Taking as a clue that the bubble disappearance position is disposed at the discharge port side of the bubble generating region, the present invention has been realized by finding from the relationship between the bubble changes and the position of the meniscus that there is a timing for enabling discharge of liquid well prior to the end of bubble disappearance at the time of preceding liquid discharge.

That is, there is a timing such that the liquid discharge head including the movable member will present such a state that bubbles which have been formed due to the preceding liquid discharge but are on the verge of disappearance exist at the discharge port side of the bubble generation region and that bubbles do not exist at the position closer to the liquid chamber. In addition, in this timing, retreat of the meniscus has started but has not reached maximum. Further, since bubbles at the movable member side of the heat-generating body have disappeared, replenishment of the liquid has been substantially completed, and is in a sufficient refilling state. Accordingly, at this timing, the liquid discharge head is in an extremely advantageous state for executing the next discharge, and the driving energy for the next liquid discharge is supplied to the heat-generating body at this timing so that a consecutive liquid discharge can be executed properly. Execution of liquid consecutive discharge at this timing means consecutive execution of liquid is an extremely short interval compared with the case where the next liquid discharge is executed after completion of bubble disappearance as in the prior art.

In the method for discharging liquid of the present invention, the driving energy for liquid discharge continues under a state that a part of bubbles formed at the time of the preceding liquid discharge and which have remained at the downstream side is supplied to the heat-generating body. The liquid flow from the upstream side that is accompanied by disappearance of the bubbles which have remained at the downstream side affects the time of the liquid discharge for the second shot and onwards. This serves to improve energy efficiency of the liquid discharge for the succeeding liquid discharge. In addition, action of liquid flow from the upstream side can enlarge the volume of the discharged liquid droplet to be discharged at the time of liquid discharge for the second shot and onwards more than the volume of the discharged liquid droplet when the liquid discharge is executed from the normal state. In addition, the liquid flow from the upstream side can accelerate the flow of the liquid at the time of the succeeding liquid discharge, and can make the speed of the discharged liquid droplets at the time of liquid discharge for the second shot and onwards faster than the speed of the discharged liquid droplets at the time the liquid discharge has been executed from the normal state.

The liquid flow accompanied by disappearance of bubbles formed at the time of such a preceding liquid discharge is decelerated at the very end of disappearance as bubble disappearance progresses. Thus, before the bubbles having been formed at the time of the preceding liquid discharge completely disappear, foaming for the second shot and onwards commences so that the above described action of the liquid flow can be obtained effectively.

Thus, the volume of consecutive discharged liquid droplets being made larger and the speed thereof being made faster than those at the normal time will give advantages that they are convenient for multi-gradation recording.

As described above, according to the method for discharging liquid of the present invention, liquid discharge can be executed in a continuous fashion at an extremely short interval. Under these circumstances, at the time of the preceding liquid discharge, the part tailing backward of the discharged liquid droplet is separated to form the satellite, which can be arranged to be captured by the discharged liquid droplets at the succeeding liquid discharge. Thus, the succeeding discharged liquid droplets are made capable of capturing the satellite will give advantages that they are convenient for multi-gradation recording.

The discharged liquid droplets following the preceding discharged liquid droplets being made capable of capturing the satellite can be obtained for the first time by executing liquid discharge in a continuous fashion at an extremely short interval with the method for discharging liquid of the present invention. Under these circumstances, the method for discharging liquid of the present invention is a method for discharging liquid having a step to heat liquid filled in inside the liquid path with a heat-generating body to generate bubbles in the liquid and a step of discharge liquid with energy at the time when the bubbles from the discharge port that communicates with the liquid path are obtained to form discharged liquid droplets to be discharged and to discharge a plurality of discharged liquid droplets in a continuous fashion by repeating these steps a plurality of times, wherein the discharged liquid droplets discharged by the succeeding liquid discharge capture satellites while the satellites keep their shape as liquid pillars, and this discharged liquid droplet and the satellite are integrated. The satellite will become approximately spherical with surface tension during flying steps, but in the method for discharging liquid according to the present invention, as described above, capture by the discharged liquid droplets while keeping its liquid pillar shape immediately after the satellite is formed can be executed.

In addition, in the method for discharging liquid according to the present invention, at liquid discharge for the second time and onwards in consecutive discharges, a part of energy that was supplied at the preceding liquid discharge can be attributed to the succeeding liquid discharge effectively. Therefore at liquid discharge for the second time and onwards, energy less than the energy to be supplied to the heat-generating body at the liquid discharge for the first time is supplied to the heat-generating body so that the liquid discharge for the second time can be executed with droplet quantity and droplet velocity equal to or more than those at the time of liquid discharge for the first time.

Thus, the arrangement to make the energy to be supplied to the heat-generating body at the liquid discharge of the consecutive discharge for the second time and onwards smaller than that for the first time can be executed in particular by making a pulse width of a voltage pulse to be applied to the heat-generating body at the liquid discharge for the second time smaller than that for the first time.

DETAILED DESCRIPTION OF THE PREFERRED EMBODIMENTS

Figure 1:
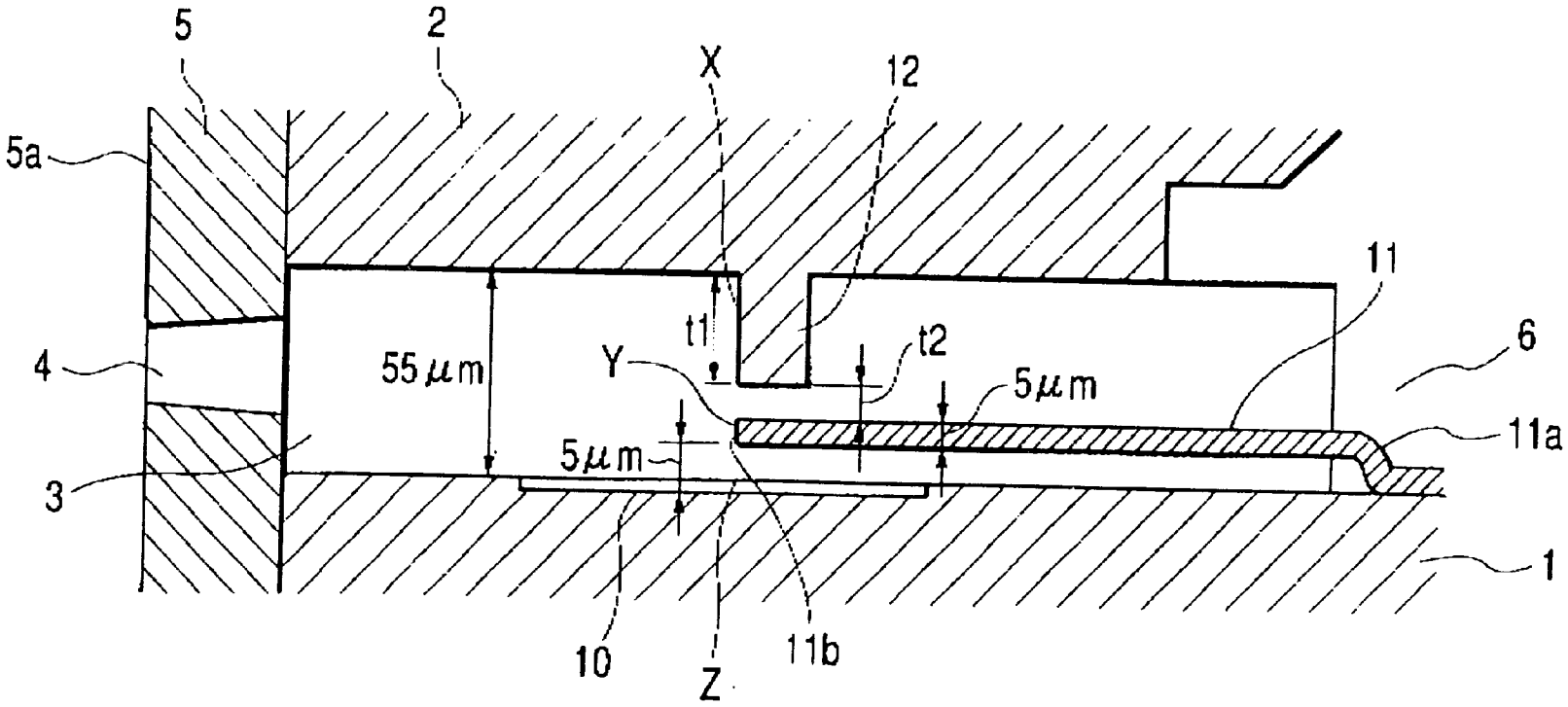
FIG. 1 is a side sectional schematic view of a liquid discharge head to be used in a method for discharging liquid of an embodiment of the present invention.

FIG. 1 is a side sectional schematic view of a key part of a liquid discharge head to be used for liquid discharge of an embodiment of the present invention. In addition, FIGS. 2A to 2F are explanatory views describing liquid discharge procedure for a single session on the liquid from the liquid discharge head having been shown in FIG. 1.

At first, with reference to FIG. 1, construction of the liquid discharge head will be described.

This liquid discharge head has an element substrate 1 having a heat-generating body 10 as bubble generation means and a movable member 11, a ceiling plate 2 where a stopper (controller) 12 has been formed and an orifice plate 5 where a discharge port 4 has been formed.

The flow path (liquid flow path) 3 where liquid flows is formed fixing the element substrate 1 and the ceiling plate 2 in a laminated state. In addition, the flow path 3 is formed plurally in parallel for one liquid discharge head, and communicates with the discharge port 4 formed in the downstream side (left side in FIG. 1) to discharge liquid. A bubble generation region exists in the region in the vicinity of a face where the heat-generating body 10 and the liquid are brought into contact. In addition, a common liquid chamber 6 with a large volume is provided so as to communicate simultaneously to the upstream side (the right side in FIG. 1) of these respective flow paths 3. That is, the respective flow paths 3 are shaped to be branched off from a single common liquid chamber 6. The height of the liquid chamber of this common liquid chamber 6 is higher than the height of the flow path of the flow path 3.

The movable member 11 is a cantilever supported at one end, and is fixed to the element substrate 1 in the upstream side of the stream of the ink (liquid), and the downstream portion lower than the pivot point 11*a* is movable upward and downward toward the element substrate 1. In addition, the movable member 11 is disposed approximately in parallel along the element substrate 1 while holding a gap toward the element substrate 1 in the initial state.

The movable member 11 disposed in the element substrate 1 has a free end 11*b* disposed so as to be positioned approximately in the central region of the heat-generating body 10. In addition, the stopper 12 provided in the ceiling plate 2 controls the displacement quantity of the free end 11*b* when the free end 11*b* of the movable member 11 contacting the stopper 12. With the displacement quantity control of the movable member 11 (at the contact of the movable member) bringing the movable member 11 into contact with the stopper 12, the flow path 3 will be substantially cut off by the movable member 11 and the stopper 12 and divided into the upstream portion of the movable member 11 and the stopper 12 and the downstream portion of the movable member 11 and the stopper 12.

It is preferable that the position Y of the free end 11*b* and the end X of the stopper 12 are disposed on the face perpendicular to the element substrate 1. Moreover,. It is further preferable that these X and Y ends together with Z, the center of the heat-generating body 10, are disposed on a face perpendicular to the substrate.

In addition, the height of the flow path 3 at the downstream side from the stopper 12 will be shaped to rise steeply. With this construction, the bubbles at the downstream side of the bubble generation region, have sufficient height also when the movable member 11 is controlled by the stopper 12. Therefore, since the growth of bubbles is not hindered, the liquid can be oriented toward the discharge port 4 smoothly and unevenness in pressure balance in the direction of height from the lower end to the upper end of the discharge port 4 is less, and good liquid discharge can be executed. Incidentally, when such a flow path construction has been adopted in the liquid discharge head without a conventional movable member 11, stagnation takes place in the portion where the flow path height at the downstream side of the stopper 12 is high, and bubbles are apt to remain in this stagnant portion, which was not preferable. But in the present embodiment as described above, the liquid flow reaches this stagnant portion so that influence of the bubble remaining will become much less.

Moreover, with the stopper 12 as a boundary, the ceiling shape at the side of the common liquid chamber 6 has been arranged to rise up steeply. In the case where this construction lacks the movable member 11, the fluid resistance in the downstream side of the bubble generation region gets smaller than the fluid resistance at the upstream side, and thus the pressure to be used for discharge is not apt to be applied to the side of the discharge port 4, but in the present embodiment, movement of bubbles to the upstream side of bubble generation region is substantially cut off with the movable member 11 when the bubbles are formed, and therefore the pressure to be used for discharge actively goes toward the side of the discharge port 4. When the liquid is supplied, the fluid resistance at the upstream side of the bubble generation region will get less so that liquid supply to the bubble generation region is arranged to be executed rapidly.

According to the above described construction, the growth component to the downstream side and the growth component to the downstream side of the bubbles are not uniform so that the growth component to the upstream side controls movement of the liquid to the upstream side less. Since the flow of liquid to the upstream side is controlled, the retreat quantity of the meniscus after discharge is less and, in turn, for that portion surpassing quantity (overshoot quantity) of the meniscus more than the orifice surface (liquid discharge face) 5*a* will be decreased. Accordingly, the meniscus vibration will be controlled so that stable discharge is executed over all kinds of driving frequencies from the low frequency to the high frequency.

Figure 4:
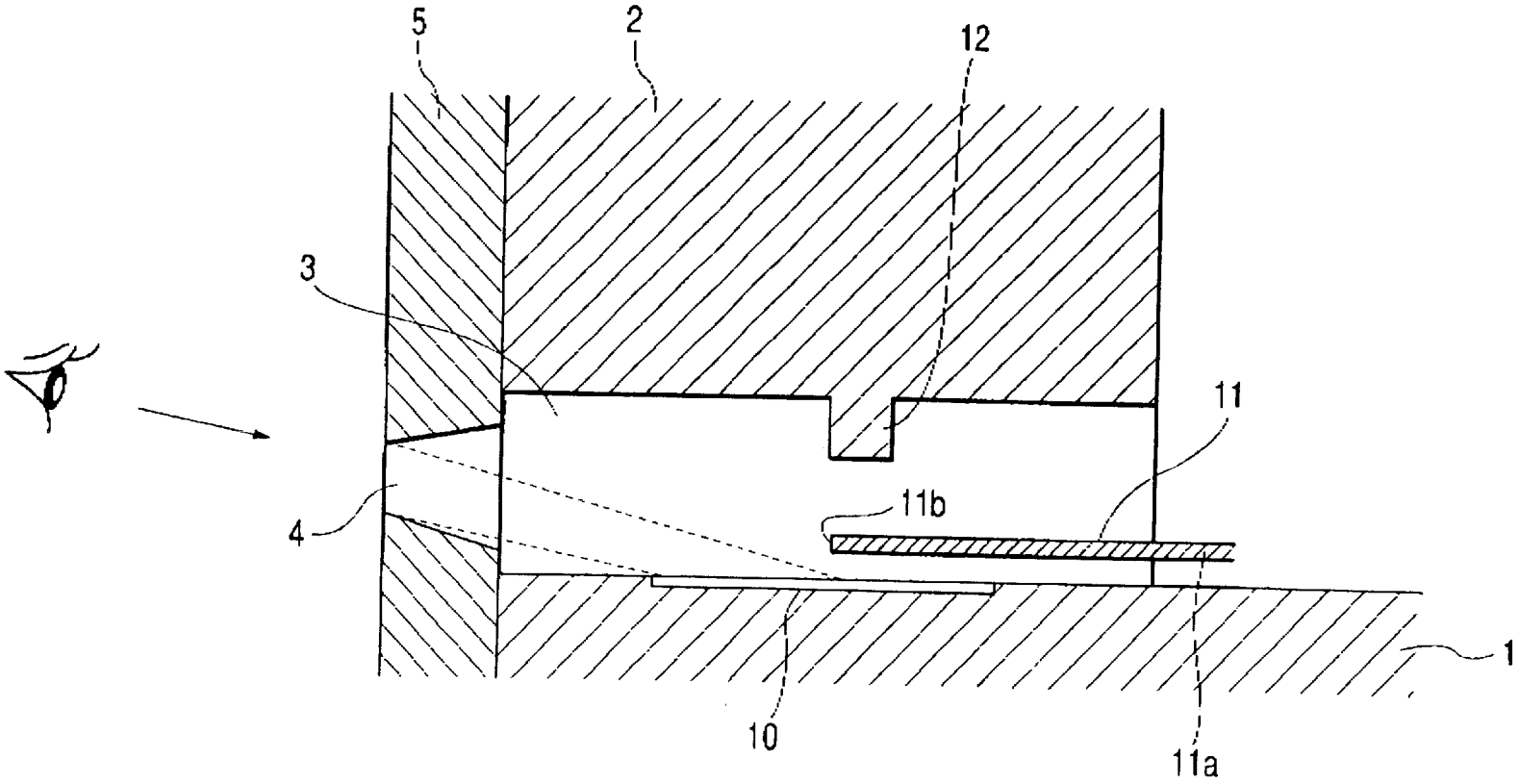
FIG. 4 is a sectional view of flow path describing a linear communication state of the liquid discharge head in FIG. 1.

Incidentally, in the present embodiment, the path between the part at the downstream side of the bubbles and the discharge port 4 maintains straight flow path structure toward for the liquid flow or "linear communication state". It is preferable that propagation direction of pressure wave taking place at the time of bubble generation and the flowing direction and the discharge direction of the liquid accompanied thereby are made to correspond linearly so that the discharge states such as the discharge direction and the discharge velocity etc. of the later described discharged droplets 66 are stabilized to an extremely high level to form an ideal state. In the present embodiment, to achieve or approximate this ideal state, such a construction is sufficient that the discharge port 4 and the heat-generating body 10, in particular the side (downstream side) of the discharge port 4 of the heat-generating body 10 having influence to the side of the bubble discharge port 4 are connected directly with straight line. This is a state that as shown in FIG. 4, the heat-generating body 10, in particular the downstream side of the heat-generating body 10, is observable by looking at it from outside the discharge port 4 under a state that the liquid does not exist inside the flow path 3.

Next, sizes of respective construction elements will be described.

In the present embodiment throwing power of bubbles to the upper face of the above described movable member (throwing power of bubbles to the upstream side of the bubble discharge region) has been studied and it has been determined that the relationship between the movement velocity of the movable member and the bubble growth velocity (in other words movement velocity of the liquid) cancels the throwing power of bubbles to the upper face of the movable member so as to make good discharge performance available.

That is, in the present embodiment, at the time that both volume change of the bubble and displacement volume change of the movable member tend to increase, displacement of the above described movable member is controlled so that the throwing power of bubbles to the upper face of the movable member is cancelled so as to make good discharge performance available.

This will be described in detail with reference to FIGS. 2A to 2E as follows.

Figure 2A:
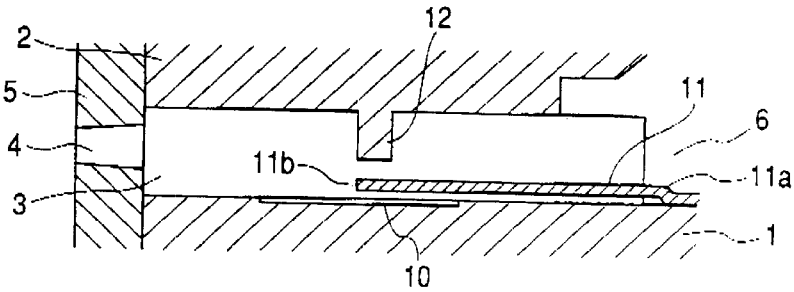
FIGS. 2A, 2B, 2C, 2D and 2E are explanatory views describing liquid discharge procedure for a single session from the liquid discharge head having been shown in FIG. 1.
Figure 2B:
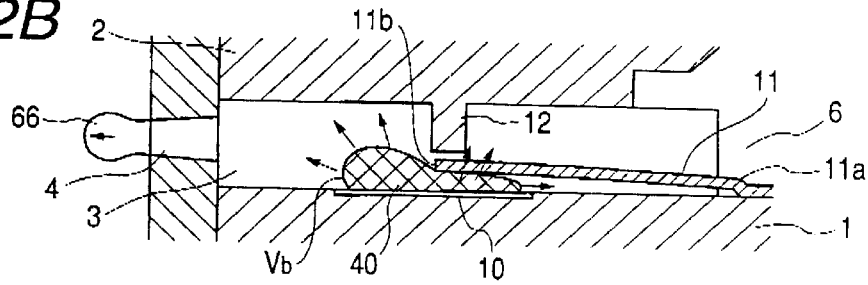

At first, from the state in FIG. 2A, bubbles are generated on the heat-generating body 10 so as to generate pressure waves instantly, and these pressure waves cause the liquid surrounding the heat-generating body 10 to move so that the bubbles 40 are growing. In addition, at first, the movable member 11 is displaced upward so as to approximately follow the movement of the liquid (FIG. 2B). Moreover when time lapses, the inertia force of the liquid getting smaller and the elastic force of the movable member 11 will make displacement velocity of the movable member 11 sharply smaller. At this time, since the movement velocity of the liquid will not get smaller to that extent, the difference between the movement velocity of the liquid and the movement velocity of the movable member 11 will get larger. And in the case where at this time the gap between the movable member 11 (free end 11*b*) and the stopper 12 is still wide, the liquid will flow into the upstream side above this gap, giving rise to creation of a state just bringing the movable member 11 and the stopper 12 into contact so that a part of the discharge force will be lost. Accordingly, in such a case, the controlling (cut off) effects of the movable member 11 by the controller (stopper 12) will not become fully exploitable.

Under theses circumstances, in the present embodiment, control of the movable member by way of controller is arranged to be executed at a stage when the displacement of the movable member approximately follows the movement of the liquid. Here, in the present invention, for the purpose of convenience, the displacement velocity of the movable member as well as the growth velocity of the bubbles (the movement velocity of the liquid) will be expressed and referred to as "movable member displacement volume change" and "bubble volume change". Incidentally, this "movable member displacement volume change" and "bubble volume change" are given by differentiating the movable member displacement volume and the bubble volume.

With such a construction, a flow of liquid that gives rise to the throwing power of bubbles to the upper face of the movable member 11 is substantially made not to occur so that the airtight state in the bubble generation region can be further secured and good discharge performance can be obtained.

In addition, according to the present construction, even after the movable member 11 has been controlled with the stopper 12, the bubbles 40 will continue to grow but at this time, in such a way to promote free growth of the components at the downstream side of the bubble 40. The distance (the protruding height of the stopper 12) between the part of the stopper 12 and the face (upper wall face) opposite the substrate 1 of the flow path 3 is made sufficient for such free growth.

Incidentally, in the present embodiment, the control of displacement of the movable member by the controller refers to a state in which displacement volume change of the movable member is zero or a negative value.

As an example, the height of the flow path 3 is 55 $\mu$m, thickness of the movable member 11 is 5 $\mu$m and clearance between the lower face of the movable member 11 and the upper face of the element substrate 1 is 5 $\mu$m under the state that the bubbles have not been generated (a state that the movable member 11 has not been displaced).

In addition, with the height being $t_1$ from the flow path wall face of the ceiling plate 2 to the tip part of the stopper 12, and the clearance being $t_2$ between the upper face of the movable member 11 and the tip part of the stopper 12, with $t_1$ being not less than 30 $\mu$m, $t_2$ should be not more than 15 $\mu$m so that the liquid can enhance a stable discharge performance. With t1 being not less than 20 $\mu$m, $t_2$ should preferably be not more than 25 $\mu$m.

Next, discharge operation for a single session of the liquid discharge head to be used in the present embodiment will be described in detail with reference to FIGS. 2A to 2E and FIG. 3 being a graph showing chronological changes between the displacement velocity and the volume of the bubbles and chronological changes between the displacement velocity and the volume of the movable member.

Figure 3:
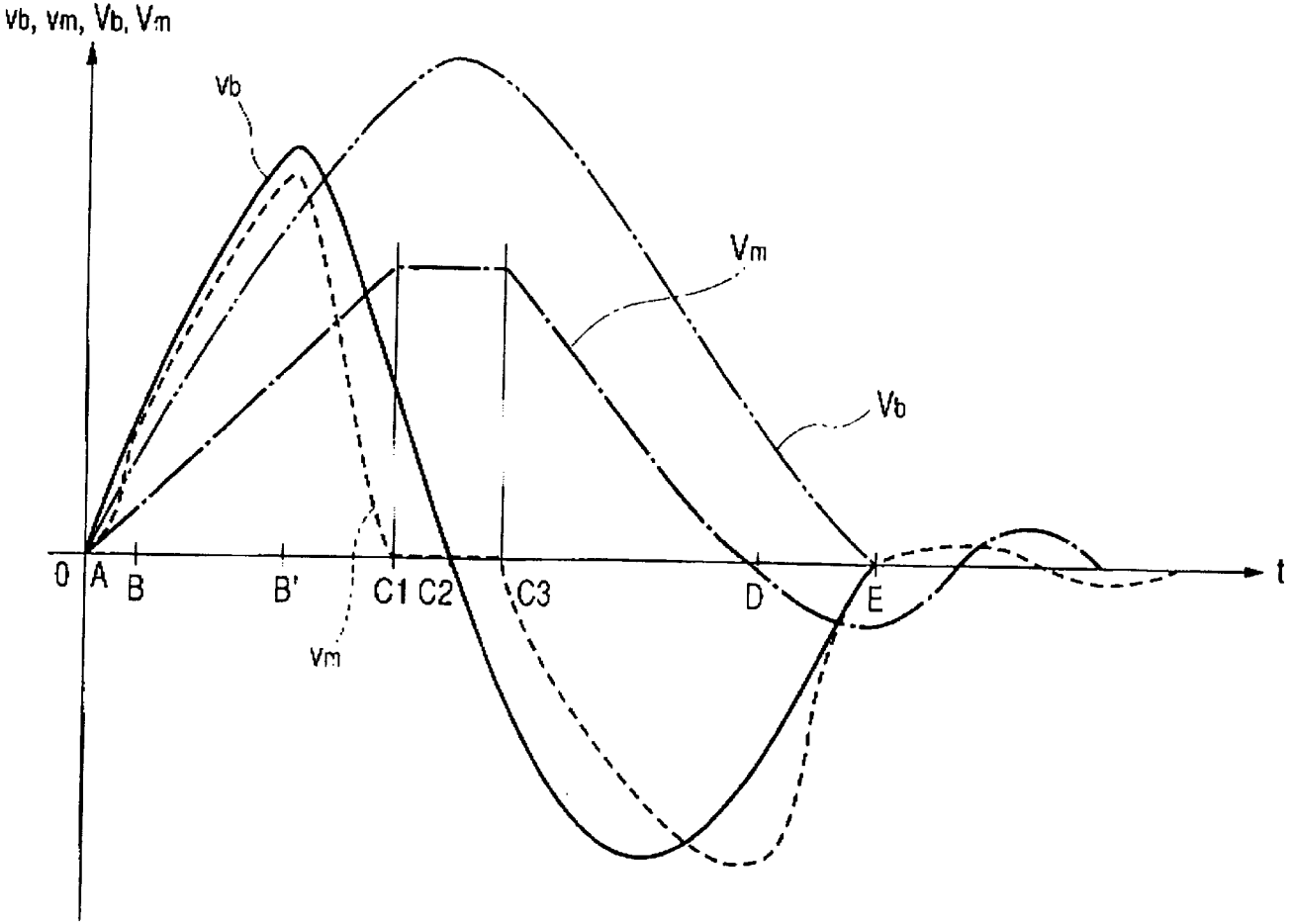
FIG. 3 is a graph showing chronological changes in displacement velocity and volume of bubbles as well as chronological changes in displacement velocity and displacement volume of movable members in the discharge procedure shown in FIGS. 2A, 2B, 2C, 2D and 2E.

In FIG. 3, the bubble volume change $v_b$ is expressed as a full line, the bubble volume $V_b$ as a two-dotted chained line, the movable member displacement volume change $v_m$ by a broken line and the movable member displacement volume change $V_m$ by single-doted chained line respectively. In addition, for the bubble volume change $v_b$, increase in the bubble volume $V_b$ is expressed as positive, for bubble volume $V_b$, increase in volume is expressed as positive, for the movable member displacement volume change $v_m$, increase in the movable member displacement volume change $V_m$ is expressed as positive and for the movable member displacement volume change $V_m$, increase in volume is expressed as positive respectively. Incidentally, since the movable member displacement volume change $V_m$ treats the volume as positive when the movable member 11 undergoes displacement from the initial state in FIG. 2A to the side of the ceiling plate 2, the movable member displacement volume change $V_m$ will give a negative value when the movable member 11 undergoes displacement from the initial state to the side of the element substrate 1.

FIG. 2A represents a state prior to application of energy such as electric energy etc. to the heat-generating body 10 and a state prior to heat generation of the heat-generated body 10. The movable member 11 is disposed in the region facing the half of the upstream side of these bubbles against the bubbles generated due to heat generation of the heat-generating body 10 as described later.

In FIG. 3, this state is equivalent to the point A with the time t=0.

In FIG. 2B, a state is shown in which a part of the liquid filling inside the bubble generation region has been heated with the heat-generating body 10 and the bubbles 40 have started foaming accompanied by film boiling. In FIG. 3, this state is equivalent to the period covering from B to the immediately before the $C_1$ point, and the state in which the bubble volume $V_b$ is getting larger as the time lapses is shown. Incidentally, at this time, displacement of the movable member 11 starts behind the volume change of the bubbles 40. That is, the pressure wave based on generation of the bubbles 40 due to film boiling propagates inside the flow path 3 and the liquid moves to the downstream side and the upstream side with the center region of the bubble generation region as a boundary so that in the upstream side, liquid flow accompanied by growth of the bubbles 40 causes the movable member 11 to start displacing. In addition, movement of liquid to the upstream side traces between the wall face of the flow path 3 and the movable member 11 to head for the side of the common liquid chamber 6. The clearance between the stopper 12 and the movable member 11 at this point of time is getting narrower as the movable member 11 undergoes displacement. In this state, discharged droplets 66 from the discharge port 4 start being discharged.

Figure 2C:
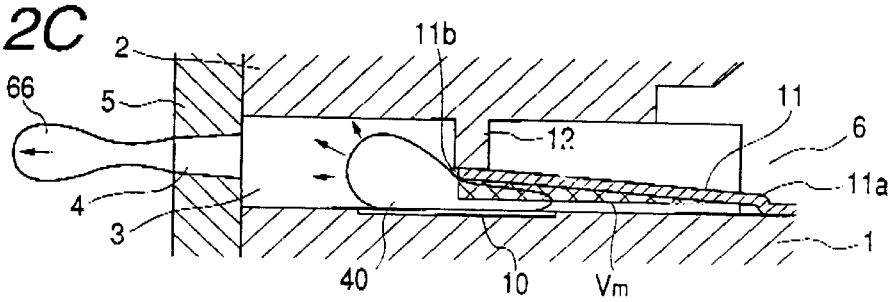

FIG. 2C shows a state in which the free end 11*b* of the movable member 11 subject to displacement due to further growth of the bubble 40 has been brought into contact with the stopper 12. In FIG. 3, this state is equivalent to the points $C_1$ to $C_3$.

The movable member displacement volume change $v_m$ steeply decreases before the movable member 11 that has come to the state shown in FIG. 2C from the state shown in FIG. 2B is brought into contact with the stopper 12, i.e., the point B' when it moves from the point B to the point $C_1$ in FIG. 3. The reason why this occurs is that immediately before the movable member 11 is brought into contact with the stopper 12, the flow resistance of liquid between the movable member 11 and the stopper 12 steeply increases. In addition, the bubble volume change $V_b$ steeply decreases.

Thereafter, the movable member 11 gets further closer to the stopper 12 so as to contact. But contact between this movable member 11 and the stopper 12 will become secured at the height $t_1$ of the stopper 12 and the clearance between the upper face of the movable member 11 and the tip part of the stopper 12 are stipulated by measures as described above. In addition, when the movable member 11 is brought into contact with the stopper 12, displacement further upward is regulated (the points $C_1$ to $C_3$ in FIG. 3) and therefore movement of liquid in the upstream direction is largely controlled. Accompanied hereby the growth to the upstream side of the bubbles 40 is also controlled with the movable member 11. However, since the movement force of the liquid to the upstream direction is large, the movable member 11 accepts stress of the form of pulling in the upstream direction to a large extent, and gives rise to a slightly upward convex deformation. Incidentally, at this time, the bubbles 40 continue to grow, but growth to the upstream side is regulated by the stopper 12 as well as the moving member 11 so that the downstream side of the bubbles 40 will further grow, and compared with the case without any movable member 11 being provided, the growth height of the bubbles 40 in the downstream side of the heat-generating body 10 will get higher. That is, as shown in FIG. 3, the movable member displacement volume change $v_m$ stays zero between the points $C_1$ to $C_3$ due to contact between the movable member 11 and the stopper 12, but the bubbles 40, which grow to the downstream side, will continue to grow to reach the point $C_2$ chronologically a little behind the point $C_1$ so that the bubble volume $V_b$ gives maximum value at this point $C_2$.

On the other hand, as described above, since the displacement of the movable member 11 is regulated by the stopper 12, the portion in the upstream side of the bubbles 40 remains in a halt state and is small until the inertia force of the liquid flow to the upstream side bends the movable member 11 to the upstream side in the convex shape so that the stress is charged. For the portion of the upstream side of these bubbles 40, the quantity to enter the region of upstream side is regulated to be approximately zero with respect to the stopper 12, the flow path side wall, the movable member 11 and the pivot point 11*a*.

This serves to regulate the liquid flow to the upstream side to a large extent and to prevent fluid crosstalk into an adjacent flow path and reverse flows of liquid in the supply path system to hamper high speed refilling, and pressure vibration.

Figure 2D:
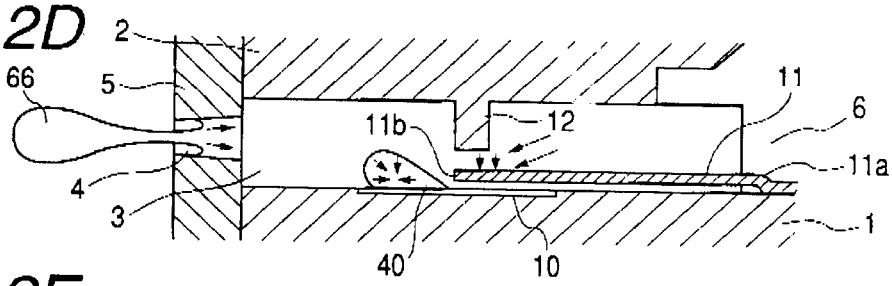

FIG. 2D shows a state in which the negative pressure inside the bubble 40 after the above described film boiling has won against movement of the liquid to the downstream side inside the flow path 3 to start shrinkage of the bubble 40.

Accompanied by shrinkage of the bubble 40 (the points C2 to E in FIG. 3) the movable member 11 undergoes downward displacement (the points C3 to D in FIG. 3), but the movable member 11 itself has the stress of a cantilever spring and the stress of the above described upward convex displacement, and thereby enhances the velocity for the downward displacement. In addition, the flow in the downstream direction of the liquid in the upstream side of the movable member 11 (a low flow path resistance region formed between the common liquid chamber 6 and the flow path 3) therefore will become a large flow rapidly to flow into the flow path 3 via the stopper 12. These operations will guide the liquid on the side of the common liquid chamber 6 into the flow path 3. The liquid guided into the flow path 3 will pass between the stopper 12 and the movable member 11 subject to downward displacement without taking any break to flow into the downstream side of the heat-generating body 10 and at the same time, will act to accelerate disappearance of the bubble 40 that has not yet completely disappeared. After aiding disappearance, this flow of liquid creates a further flow in the direction of the discharge port 4 to help recovery of the meniscus and improve refilling velocity.

At this stage, the liquid pillar made of discharged droplets 66 having come out from the discharge port 4 will form liquid droplets to fly to outside. FIG. 2D shows a state that the meniscus is pulled into the inside the discharge port 4 due to bubble disappearance, and the liquid pillar of the discharged droplets 66 is about to be pulled apart.

In addition, flow into the flow path 3 through the part between the above-described movable member 11 and the stopper 12 enhances the flow speed on the ceiling plate 2 side, and therefore very few microbubbles remain in this part, thereby contributing to stability of discharge.

Moreover, since the capitation generation point due to bubble disappearance undergoes displacement to the downstream side of the bubble generation region as well, damage to the heat-generating body 10 will be less. At the same time, fewer scorched parts will be attached to the heat-generating body 10 in this region due to the above-described phenomena and discharge stability is improved.

Figure 2E:
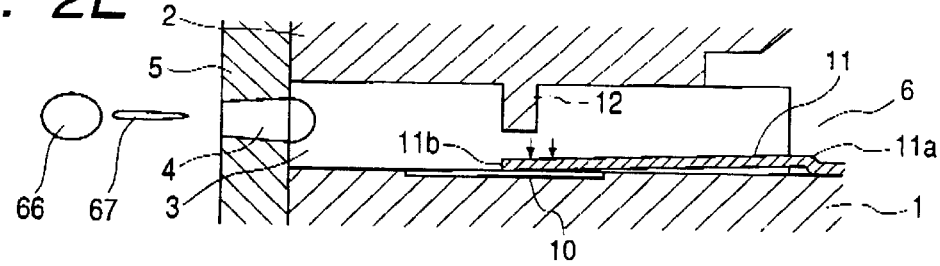

FIG. 2E shows the state (the point E and onwards in FIG. 3) in which the movable member 11 has undergone overshoot downward from the initial state for displacement after the bubble 40 has completely disappeared.

This overshoot of this movable member 11 undergoes attenuation convergence in a short time to return to the initial state, but it depends on rigidity of the movable member 11 and viscosity of the liquid used.

FIG. 2E shows the state that the meniscus has been pulled in to reach considerably the upstream side due to bubble disappearance, but returns to the stable position in a comparatively short time and is stabilized as attenuation convergence of the displacement of the movable member 11. In addition, as described in FIG. 2E, there is a case that the satellite 67 which has been formed behind the discharged droplet 66 by the part resembling a tail due to surface tension being separated is formed.

Figure 5:
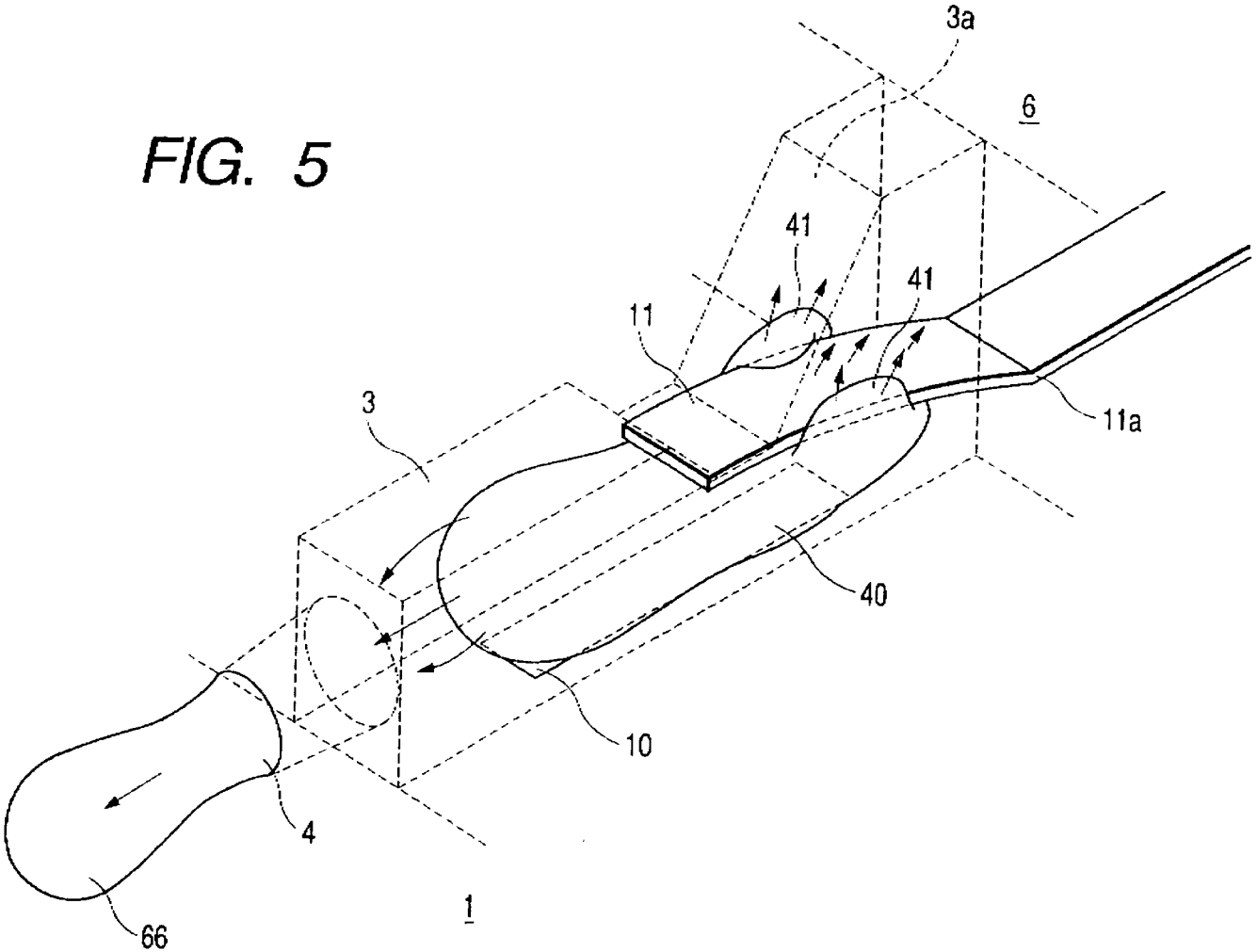
FIG. 5 is a transparent perspective view showing a part of the heads having been shown in FIG. 1.

Next, with reference to FIG. 5, a perspective view of a part of heads having been shown in FIG. 1, in particular, a protuberance bubble 41 elevating from the both parts of the movable member 11 as well as the meniscus of the liquid in the discharge port 4 will be described in detail. Incidentally, the shape of the stopper 12 and the shape of the low flow path resistance region 3*a* in the upstream side of the stopper 12 as shown in FIG. 5 is different from that shown in FIG. 1, but basic features are similar.

In the present embodiment, a slight clearance exists between the wall surface of both sides of the wall constructing the flow path 3 and both side parts of the movable member 11 which enables smooth displacement of the movable member 11. Moreover, the bubbles 40 displace the movable member 11 in the growth step of foaming with the heat-generating body 10, and elevate to the upper face side of the movable member 11 via the above-described clearance to slightly invade to the low flow path resistant region 3*a*. This elevated bubble 41 having invaded comes around to the back surface (the bubble generation region and the opposite surface) of the movable 11 to control blurring of the movable member 11 to stabilize the discharge features.

Moreover, in the disappearing step of the bubble 40, the elevated bubble 41 promotes the liquid flow from the low flow path resistant region 3*a* to the bubble generation region to swiftly finalize disappearance with the above-described rapid meniscus retraction from the discharge port 4 side. In particular, the liquid flow that the elevated bubble 41 causes will hardly store and hold the bubble at the corner of the movable member 11 and the flow path 3.

Thus, for the liquid discharge head of the above described construction, at that moment when liquid is discharged from the discharge port 4 due to generation of the bubble 40, the discharged droplet 66 is discharged in a state resembling a liquid pillar having a bulb part at the tip. This issue is the same also in the conventional head structure, but in the present embodiment, when the bubble growth step displaces the movable member 11 and this displaced movable member 11 contacts the stopper 12, the flow path 3 having the bubble generation region removes the discharge port and a substantially closed space is formed. Accordingly, if the bubbles disappeared in this state, until the movable member 11 departs from the stopper 12 due to bubble disappearance, the above described closed space is maintained, and therefore almost all the disappearance energy of the bubble 40 will function as power to move the liquid in the vicinity of the discharge port 4 in the upstream direction. As a result thereof, immediately after disappearance of the bubble 40 starts, a meniscus is rapidly pulled inside the flow path 3 from the discharge port 4, the tailing part forming the liquid pillar by being integrated with the discharged droplet 66 outside the discharge port 4 is swiftly cut off with a strong force by the meniscus. This can serve to make satellite dots formed from the tailing part small to improve the print type grade.

Moreover, the tailing part does not continue to be pulled by the meniscus forever so that the discharge velocity does not decrease, but the distances between the discharged droplets 66 and the satellite dots are shortened, and therefore the satellite dot is drawn in by the so-called strip stream phenomena behind the discharged droplet 66. As a result thereof, the discharged droplet 66 and the satellite dots can be united, and the liquid discharge head almost lacking the satellite dots can be provided.

Moreover, in the present embodiment, in the above described liquid discharge head, the movable member 11 is provided only for restraining the bubbles 40 growing in the upstream direction on the liquid flow toward the discharge port 4. Further preferably, the free end 11*b* of the movable member 11 is disposed in the substantially center part of the bubble generation region. This construction serves to enable controlling the back wave to the upstream side due to bubble growth as well as inertia force of the liquid that is not directly influential for the liquid discharge, and to gently direct the growing component of the bubbles 40 toward the downstream side in the direction of the discharge port 4.

Moreover, since flow path resistance of the low flow path resistance region 3*a* in the opposite side of the discharge port 4 with the stopper 12 as a boundary is low, movement of the liquid in the upstream direction due to the bubble 40 growth will become large by the low flow path resistance region 3*a*, and therefore when the displaced movable member 11 is brought into contact with the stopper 12, the movable member 11 will receive stress in the form of pulling in the upstream direction. As a result thereof, even if bubble disappearance is started in this state, the liquid movement force in the upstream direction due to the bubble 40 remains large and therefore the above described closed space can be held for a constant period until the resisting force of the movable member 11 surpasses this liquid movement force. That is, this construction will make high speed meniscus retraction firm. In addition, when the disappearing step of the bubble 40 progresses and the repulsion of the movable member 11 surpasses the liquid movement force in the upstream direction due to bubble growth, the movable member 11 is displaced downward so as to return to the initial state, and the displacement is accompanied by a flow in the downstream direction in the low flow path resistance region 3*a* as well. The flow in the downstream direction in the low flow path resistance region 3*a* is small and thus will constitute a large flow into the flow path 3 via the stopper 12. As a result thereof, liquid movement in the downstream direction toward this discharge port 4 can serve to rapidly decelerate the retraction of the above described meniscus and to converge vibration of the meniscus at a high velocity.

The method for discharging liquid of the present invention features continuous discharge of liquid at high frequency with the liquid discharge head as having been described so far. Under this circumstance, next with reference to FIGS. 6A to 6F and FIG. 7, operations in the case where the liquid discharge is executed in a consecutive manner at a short interval will be described. FIG. 7 is a graph schematically showing the wave form of the voltage pulse to be applied to the heat-generating body 10.

Figure 6A:
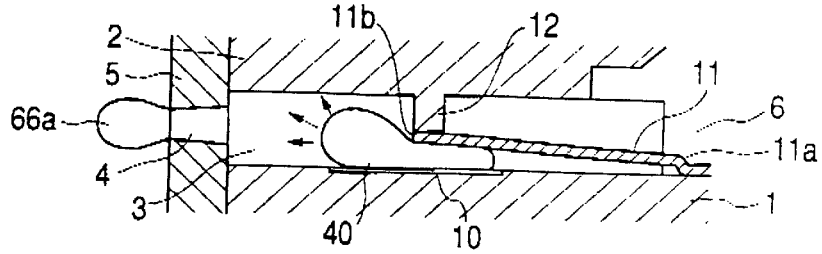
FIGS. 6A, 6B, 6C, 6D, 6E and 6F are schematic sectional view showing states in respective procedures when a consecutive discharge has been executed with the liquid discharge head in FIG. 1.
Figure 7:
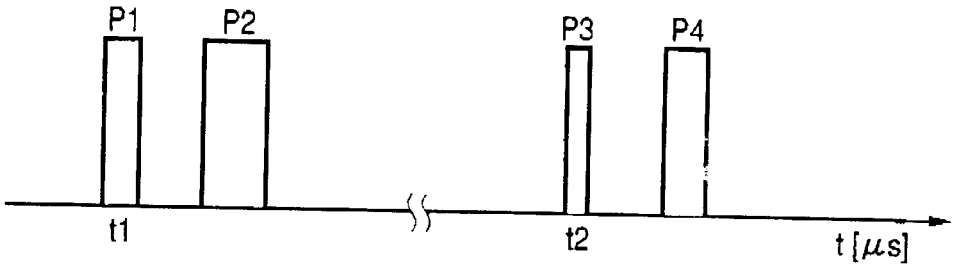
FIG. 7 is a schematic graph showing waveforms of a voltage pulse to be supplied to the heat-generating body when a consecutive discharge is executed as shown in FIGS. 6A, 6B, 6C, 6D, 6E and 6F.

At first, as shown in FIG. 6A, the voltage pulse is applied to the heat-generating body 10 for the first time so that the bubble 40 is formed and the first discharge droop 66*a* is formed. At this time, in the present embodiment, as shown in FIG. 7, as the voltage pulse, a double pulse consisting of a prepulse P1 and a main pulse P2 is applied at a predetermined time t1. In this double pulse drive, application of the prepulse P1 preheats the heat-generating body 10 and the liquid in the vicinity thereof so that the liquid can be caused to foam well when the main pulse P2 has been applied subsequently. As described above, in this foaming procedure, the movable member 11 is brought into contact with the stopper 12 to undergo displacement until it reaches the state to substantially close the upstream side so that the movement of the liquid in the upstream direction is largely limited. In addition, the bubble 40 grows large to the downstream side.

Figure 6B:
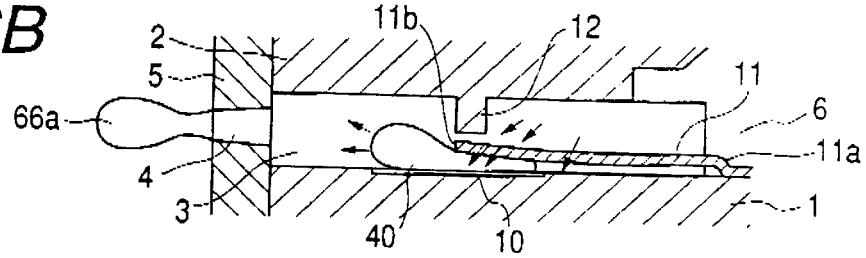

From this state, disappearance of the bubble 40 as shown in FIG. 6B in particular volume decrease) in the upstream side of the bubble 40 starts so that the movable member 11 starts downward displacement and refilling of the liquid commences. As described above, with movement of this movable member 11, disappearance of the bubbles is accelerated, and in particular, is largely accelerated in the bubble generation region upstream side where the movable member 11 is located.

Figure 6C:
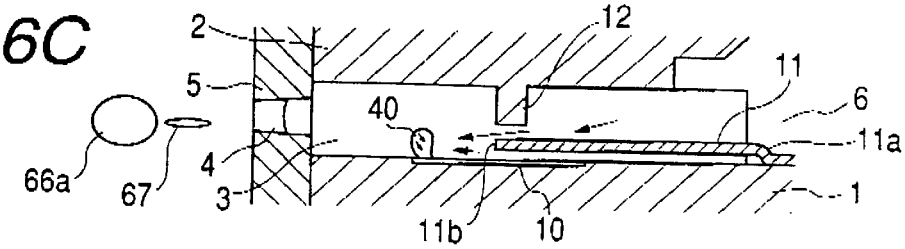

Thus, disappearance is accelerated in the upstream side of the bubble generation region and the bubble 40 grow large to the downstream side, and therefore, when the bubble disappearance procedure progresses, bubble disappearance is approximately completed in the upstream side of the bubble generation region as shown in FIG. 6C, giving rise to a state in which the bubble 40 remains only in the vicinity of the downstream. In this state, the liquid is refilled from the upstream side of the bubble generation region and refilling takes place to cover from the center of the heat-generating body 10 to the downstream side. In addition, the meniscus is retracted to inside the discharge port 4, and hereby the first discharged droplet 66*a* and the satellite 67 are cut off from the liquid inside the liquid discharge head, but under the state, as shown in FIG. 6C, in which the bubble 40 is not yet completely disappeared, in particular, in the downstream side of the bubble 40, the meniscus has not reached the state that, as shown in FIG. 2E, it has been retracted comparatively large to inside the liquid discharge port 4, but is in the state in which it still remains comparatively closer to the liquid discharge face.

In the method for discharging liquid of the present embodiment, under this state, the voltage pulse is applied to the heat-generating body 10 for the second time so that foaming for the second time starts. That is, under this state, the meniscus is in the vicinity of the liquid discharge face, and a constant liquid refilling is completed to the upstream side of the heat-generating body 10, and therefore, the voltage pulse applied from this state to start foaming serves to enable the liquid to be discharged properly. At this foaming for the second time, as shown in FIG. 7, a double pulse drive is executed by applying the prepulse P3 and the main pulse P4 at the time t2 after a predetermined time has lapsed from the time t1. At this time, foaming for the second time is started substantially at the same time when the main pulse P4 is applied. Accordingly, in the present embodiment, as described above, the statement that foaming starts at the timing when the bubble 40 remains only in the vicinity of the downstream side end part of the bubble generation region means to start application of the main pulse P4 at this timing.

Figure 6D:
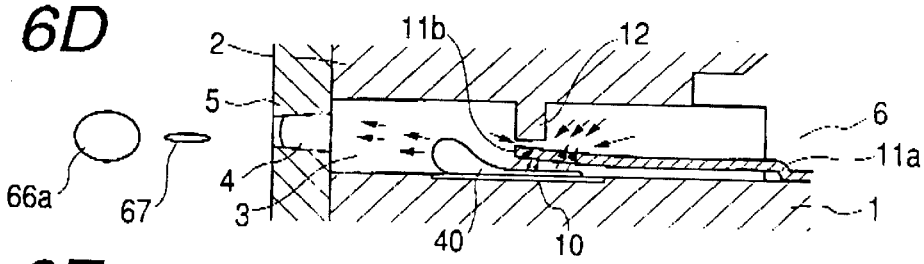

When the voltage pulse is applied, the bubble 40 starts growing as shown in FIG. 6D and the movable member 11 starts upward displacement. At this time, when foaming starts, the bubble 40 is conditioned to partially remain in the downstream side, and therefore foaming is executed in a state that a liquid flow from the upstream side accompanied by disappearance of the remaining bubbles has taken place. This can serve to cause the liquid flow taking place accompanied by growth of the bubble 40 to act on the liquid flow accompanied by bubble disappearance after liquid discharge for the previous time so as to give rise to a liquid flow in the discharge direction immediately. In addition, the meniscus will be retracted less than at the time of liquid discharge for a single session, and starts its movement from the position shown in FIG. 6C to the downstream side as shown in FIG. 6D.

Here, the liquid flow accompanied by bubble disappearance formed in the previous liquid discharge is decelerated immediately before the end of the disappearance as bubble disappearance progresses. Therefore, before disappearance of the bubbles formed at the previous time of liquid discharge comes to an end, foaming for the second session and onward starts so that influence of the liquid flow as described above can be obtained effectively.

Figure 6E:
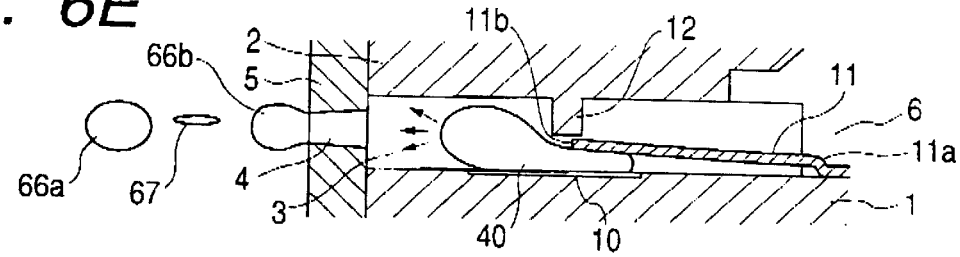
Figure 6F:
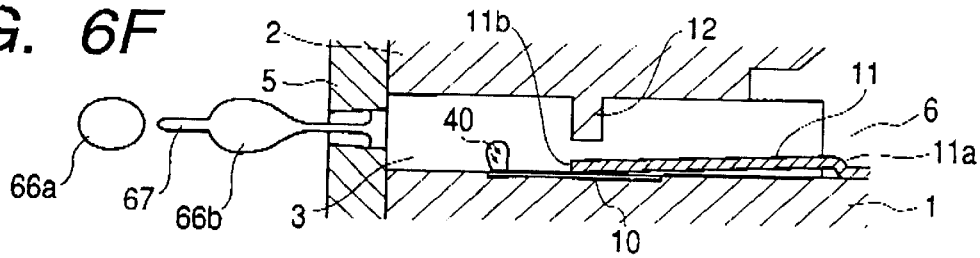

In addition, as shown in FIG. 6E, the bubble 40 will further grow so that the second discharged droplet 66*b* is discharged. At this time, due to influence of bubble disappearance after the previous liquid discharge as described above, the volume of the second discharged droplet 66*b* gets larger than that of the first time. In addition, in particular, it is possible to arrange that the volume $V_{d2}$ of the second discharged droplet 66*b* to get bigger than the sum of the volume $V_{dm1}$ of the first discharged droplet 66*a* and the volume $V_{ds1}$ of the satellite 67 thereof, that is, to give $V_{d2}>(V_{dm1}+V_{ds1})$.

In addition, in the state in which a comparatively fast liquid flow toward the upstream side has taken place due to refilling, the foaming for the second time starts, and therefore the liquid flow toward the heat-generating body 10 from the discharge port 4 is cancelled due to foaming for the second time. Moreover, at the time when liquid flow to the further upstream side is formed, momentum of the liquid flow from the upstream side of the heat-generating body 10 is added to the liquid flow toward the discharge port 4 to accelerate the flow. Therefore, compared with the speed $v_1$ of the first discharged droplet 66*a*, the speed $v_2$ of the second discharged droplet 66*b* can be arranged to be faster.

Thus arrangement of $v_1>v_2$ is also possible in the case where the volume of the second discharged droplet 66*b* is larger than that of the first discharged droplet 66*a* as described above, that is $V_{d2}>(V_{dm1}+V_{ds1})$. This shows that a part of thermal energy generated at the time of the first liquid discharge contributes to the second liquid discharge.

Moreover, it is possible to arrange the second discharged droplet 66*b* to catch up with the liquid pillar type satellite 67 immediately after separation so as to execute integration, that is, to cause the second discharged droplet 66*b* to capture the satellite 67. In this case, the volume after the second discharged droplet 66*b* has captured the satellite 67 will become $V_{d2}+V_{ds1}$, and of course it is possible to make $(V_{d2}+V_{ds1})>V_{dm1}$.

Thus, discharge amount of the liquid for the first discharged droplet 66*a* and the second discharged droplet 66*b* are changed so that, for example, sizes of the forming pixel are changed and the gradation is changed to enable execution, etc. of recording. In addition, the satellite 67 at the first liquid discharge is caused to be absorbed by the second discharged droplet 66*b* so that the gradation difference can be made large. Moreover, a plurality of discharged liquid droplets are discharged in a consecutive manner and these plurality of discharged liquid droplets are arranged to be integrated in the course of flying to the recording medium to be recorded so that, for example, multi-gradation recording can be executed.

As having been described so far, according to the method for discharging liquid in the present embodiment, in the state in which the bubble 40 still remains in the upstream side of the bubble generation region in disappearing step of the first liquid discharge, the voltage pulse for the second liquid discharge is applied to foam the liquid, so that the liquid discharge can be executed properly in a consecutive manner at an time interval that is short beyond the limit of the prior art, that is, the liquid discharge head can be driven at an extremely high frequency. At this time, compared with the first liquid discharge in which the liquid discharge starts from the normal state, the discharge amount for the second liquid discharge can be made abundant, and moreover the discharge velocity can be made fast. In addition, since a portion of the thermal energy generated at the first liquid discharge contributes to foaming at the second liquid discharge, energy efficiency for discharge can be improved.

Next, a method for discharging liquid in another embodiment of the present invention will be described with reference to FIGS. 8A to 8F and FIG. 9. In FIGS. 8A to 8F and FIG. 9, the similar part in the preceding embodiment shares the same symbol and description thereon will be omitted.

As described above, according to the method for discharging liquid in the present invention, the liquid flow from the upstream side taking place by high speed refilling of the liquid that is accompanied by disappearance of the bubble 40 formed at the preceding liquid discharge can be made to contribute to the succeeding liquid discharge effectively. That is, a part of applied energy at the preceding liquid discharge can be utilized as energy for the succeeding liquid discharge. Under the circumstances, even if the energy to be applied at the second liquid discharge and onwards is made less than the energy to be applied at the first liquid discharge, the energy to effectively contribute to discharge can be made equivalent to the energy for the first time or more than that. The present embodiment directs its attention to this issue, and shows a method for discharging liquid by making the energy to be applied at the second liquid discharge and onwards in consecutive discharge less than the energy to be applied at the first liquid discharge. In the present embodiment, to be concrete, an example of changing pulse width of the voltage pulse to be applied to the heat-generating body 40 so as to change the energy to be applied is shown.

Figure 8A:
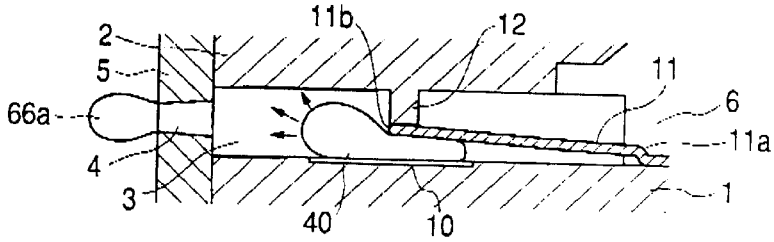
FIGS. 8A, 8B, 8C, 8D, 8E and 8F are schematic sectional view showing states in respective procedures when a consecutive discharge has been executed in another embodiment of the present invention.

Also in the present embodiment, the voltage pulse is applied to the heat-generating body 10 at first so that the first discharged droplet 66*a* is discharged as shown in FIG. 8A. At this time, as the voltage pulse, as shown in FIG. 9, a double pulse consisting of a prepulse P1 and a main pulse P2 is applied at a predetermined time t1.

Figure 8B:
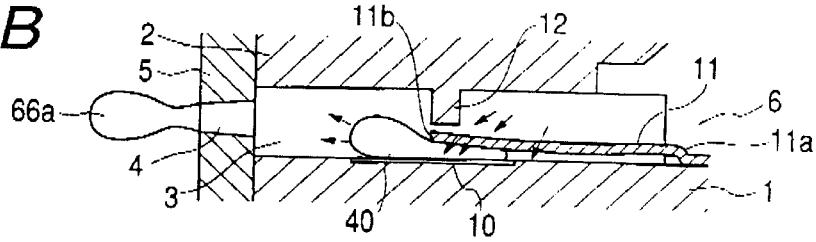
Figure 8C:
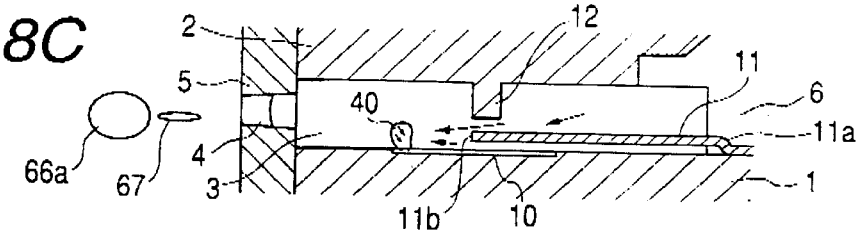

The bubble 40 reaches the maximum foam, and thereafter, as shown in FIG. 8B, starts undergoing bubble disappearance to lose volume largely in particular in the upstream side. In addition, as shown in FIG. 8C, in the state in which the bubble 40 remains only in the vicinity of the downstream side end part of the bubble generation region, the second voltage pulse is applied to start the second foaming.

Figure 9:
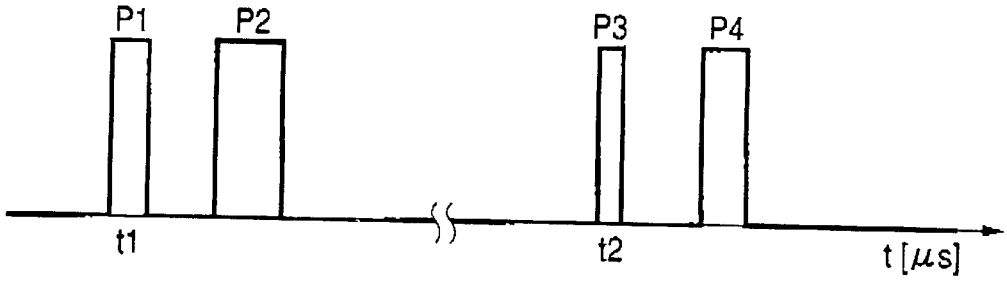
FIG. 9 is a schematic graph showing waveforms of a voltage pulse to be supplied to the heat-generating body when a consecutive discharge is executed as shown in FIGS. 8A, 8B, 8C, 8D, 8E and 8F.
Figure 10:
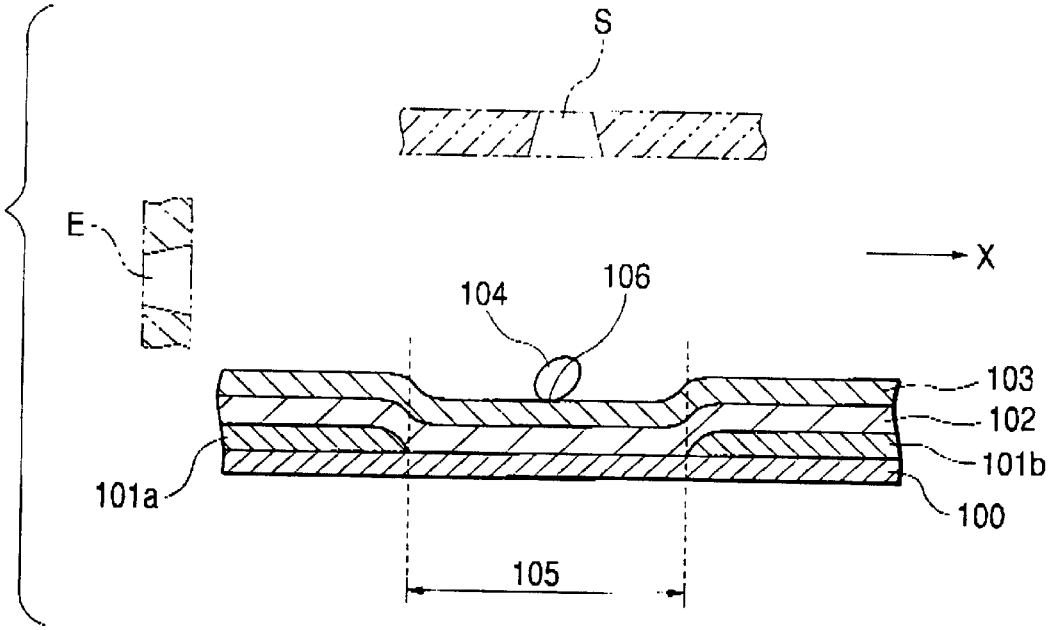
FIG. 10 is a schematic sectional view showing construction in the vicinity of the heat-generating body of a prior art liquid discharge head.

Also for the second voltage pulse, as shown in FIG. 9, a double pulse consisting of a prepulse P3 and a main pulse P4 is applied. Here, in the present embodiment, the pulse widths of these prepulse P3 and main pulse P4 are made shorter than the pulse width at the first foaming. To be concrete, for the first time, the pulse width of the prepulse P1 was set at 0.7 $\mu$s and the pulse width of the main pulse P2 was set at 1.3 $\mu$s while for the second time, the pulse width of the prepulse P3 was set at 0.4 $\mu$s and the pulse width of the main pulse P4 was set at 0.9 $\mu$s.

At this time, the timing for starting the second foaming will be substantially the same as the timing to apply the main pulse P4 as described above. Accordingly, since the bubble 40 of the first foaming starts foaming at a timing left only in the vicinity of the downstream side end part of the bubble generation region, the voltage pulse is applied so that application of the main pulse P4 starts at this timing. In the present embodiment, to be concrete, application of the second voltage pulse P3 started at the time t2 being 17 $\mu$s after the time t1 when application of the first voltage pulse P1 had started to adjust the foaming timing.

Figure 8D:
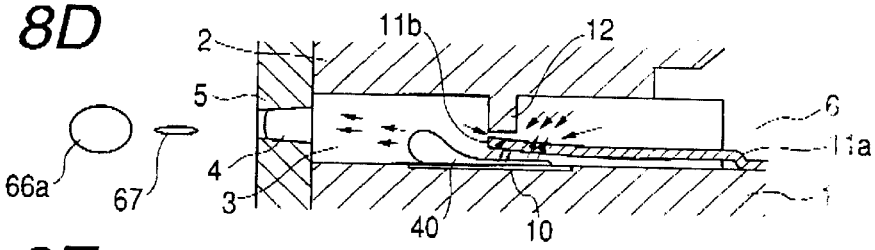
Figure 8E:
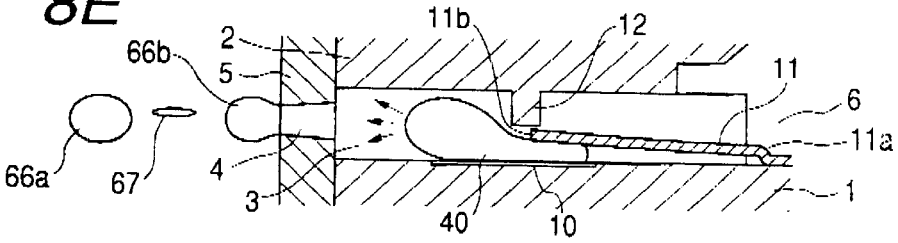
Figure 8F:
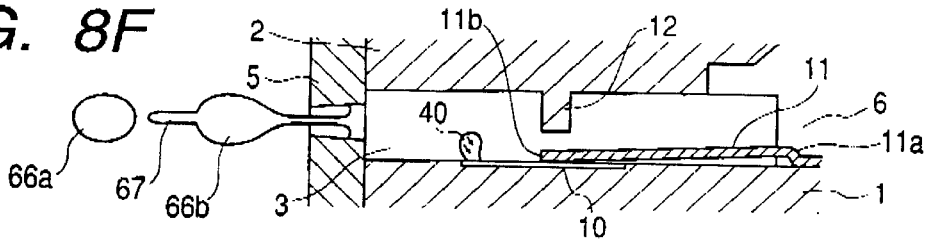

Thus, applying the second voltage pulse, as shown in FIG. 8D, the liquid is caused to bubble so that the second discharged droplet 66*b* is caused to be discharged as shown in FIG. 8E. Although the size of the bubble 40 taking place due to application of the second voltage pulse as well as of the second discharged droplet 66*b* will become smaller than in the case in the previous embodiment, the amount of the second discharged droplet 66*b* can be equivalent to or more than that of the first discharged droplet 66*a* due to action of the liquid flow of refilling. In addition, the speed of the discharged droplet 66*a* can be made equivalent to or faster than that of the first discharged droplet 66*a*, and as shown in FIG. 8F, the satellite 67 having been formed at the previous liquid discharge can be caused to be captured by the second discharged droplet 66*b*. In particular, while the satellite 67 is in the state of a liquid pillar, it can be caused to be captured by the second discharged droplet 66*b*, and moreover, it is also possible to cause the first discharged droplet 66*a* to be captured by the second discharged droplet 66*b* during flight.

As having been described so far, according to the present embodiment, a part of energy having been supplied to the heat-generating body 10 at the preceding liquid discharge can be made to effectively contribute to the succeeding liquid discharge in a mode of liquid flow of high speed refilling, and supply of energy less than that at the preceding liquid discharge to the heat-generating body 10 can cause liquid droplets of amount and speed equivalent to or more than those at the preceding liquid discharge to be discharged.

Thus, according to the present embodiment, the energy to be supplied for obtaining the required discharge performance can be substantially suppressed. Therefore, energy saving of the consumption energy in the liquid discharge head can be planned, and unnecessary temperature increase of the liquid discharge head can be suppressed. Accordingly, according to the present embodiment, in particular, as in the method for discharging liquid in the present invention, also in the case where the liquid discharge head is driven at a high speed, with suppression of the supplied energy, the power as well as the driving circuit will not have to be made as large, and cost increase can be suppressed. In addition, changes in discharge features as well as decrease in reliability due to heating in the liquid discharge head can be suppressed.

As described above, according to the method for discharging liquid in the present embodiment, under the state that the bubble still remains in the downstream side of the bubble generation region in disappearing step of the preceding liquid discharge, the voltage pulse for the succeeding liquid discharge is applied, so that the liquid discharge can be executed properly in a consecutive manner at a time interval that is short beyond the limit of the prior art. That is, the liquid discharge head can be driven at an extremely high frequency. At this time, compared with the case in which the liquid discharge starts from the normal state, the discharge amount of the discharge drop at the time of consecutive discharge can be made large, and moreover the discharge velocity can be made fast. In addition, a portion of the generated energy at the preceding liquid discharge can be caused to contribute to the succeeding liquid discharge, and energy efficiency for liquid discharge can be improved.

In addition, the discharge amount of the discharge drop for the first session as well as the discharge amount of the discharge drop for the second session and onwards are changed, and the discharged liquid droplets for the second session and onwards are made to capture the satellite of the preceding discharge drop and moreover the preceding discharge drop itself so that the attached liquid amount onto respective image point is caused to change and gradation recording can be suitably made.

In the method for discharging liquid in the present invention, even if the energy to be supplied to the heat-generating body at the second session and onwards in the consecutive discharges is made less than the energy to be supplied at the first liquid discharge, the amount and speed of liquid droplets to take place by foaming for the second session and onwards can be made equivalent to those for the first session or not less than the first session. Therefore, energy saving can be contemplated, and heating in the liquid discharge head can be suppressed.

What is claimed is:

1. A method for discharging liquid, in which a plurality of discharged liquid droplets are discharged from a same discharge port by using a liquid discharge head, said method comprising the steps of:

providing the liquid discharge head comprising a heat-generating body to generate thermal energy for generating a bubble in a liquid, the discharge port through which the liquid is discharged, a liquid flow path communicating with the discharge port and having a bubble generation region to generate the bubble in the liquid, a liquid chamber to supply the liquid flow path with the liquid, a movable member provided in the bubble generation region to be displaced by growth of the bubble, and a controller to control displacement of the movable member within a desired range, with the heat-generating body and the discharge port being in a linear communication arrangement so that the liquid is discharged from the discharge port due to the energy from the bubble generation, the controller being provided facing the bubble generation region of the liquid flow path, and in the liquid flow path the bubble generation region defines a substantially closed space, except the discharge port, by substantial contact between the displaced movable member and the controller; and after commencement of disappearance of the bubble formed by a preceding liquid discharge, and under a state that the bubble remains biased at the discharge port side in the bubble generation region and a portion where the bubble does not exist is given rise at the liquid chamber side of the bubble generation region, generating a bubble in the liquid by supplying the heat-generating body with driving energy for a succeeding liquid discharge.

2. The method for discharging liquid according to claim 1, wherein a volume of the discharged liquid droplets to be discharged in a second liquid discharge and subsequent discharges is larger than a volume of a discharged liquid droplet when liquid discharge is executed from a normal state.

3. The method for discharging liquid according to claim 1 or 2, wherein a speed of the discharged liquid droplets discharged at the time of the second liquid discharge and subsequent discharges is faster than a speed of discharged liquid droplets at a time when liquid discharge is executed from a normal state.

4. The method for discharging liquid according to claim 1, wherein the plurality of discharged liquid droplets are discharged in a consecutive manner and are integrated in the course of flight to a recording medium to be recorded.

5. A method for discharging liquid comprising:

a step of heating a liquid filling a liquid flow path with a heat-generating body to generate a bubble in the liquid; and a step of discharging the liquid from a discharge port communicating with the liquid flow path using energy produced in the bubble generation, the steps being repeated plural times to discharge a plurality of liquid droplets in a consecutive manner, wherein at a preceding liquid discharge, a satellite formed with a part tailing backward in a discharged liquid droplet being separated is captured by another discharged liquid droplet from a succeeding liquid discharge while the satellite is in the shape of a liquid pillar so that the other discharged liquid droplet is integrated with the satellite.

6. The method for discharging liquid according to claim 5, wherein a volume of the discharged liquid droplets to be discharged in a second liquid discharge and subsequent discharges is larger than a volume of a discharged liquid droplet when liquid discharge is executed from a normal state.

7. The method for discharging liquid according to claim 5 or 6, wherein a speed of the discharged liquid droplets discharged at the time of the second liquid discharge and subsequent discharges is faster than a speed of discharged liquid droplets at a time when liquid discharge is executed from a normal state.

8. The method for discharging liquid according to claim 5, wherein a volume $V_{d2}$ of a succeeding discharged liquid droplet is made greater than a sum of a volume $V_{dm1}$ of a preceding discharged liquid droplet and a volume $V_{ds1}$ of the satellite thereof, such that $V_{d2}>(V_{dm1}+V_{ds1})$.

9. The method for discharging liquid according to claim 1 or 5, wherein in a second liquid discharge and subsequent discharges in the consecutive discharge mode, energy less than energy supplied to the heat-generating body in a first liquid discharge is supplied to the heat-generating body.

10. A method for discharging liquid, in which a plurality of discharged liquid droplets are discharged from a same discharge port by using a liquid discharge head, said method comprising the steps of:

providing the liquid discharge head comprising a heat-generating body to generate thermal energy for generating a bubble in a liquid, the discharge port through which the liquid is discharged, a liquid flow path communicating with the discharge port and having a bubble generation region to generate the bubble in the liquid, a liquid chamber to supply the liquid flow path with the liquid, a movable member provided in the bubble generation region to be displaced by growth of the bubble, and a controller to control displacement of the movable member within a desired range, with the heat-generating body and the discharge port being in a linear communication arrangement so that the liquid is discharged from the discharge port due to the energy from the bubble generation, the controller being provided facing the bubble generation region of the liquid flow path, and in the liquid flow path the bubble generation region defines a substantially closed space, except the discharge port, by substantial contact between the displaced movable member and the controller; and in a second liquid discharge and subsequent discharges in a consecutive discharge mode, supplying energy, less than energy supplied to the heat-generating body in a first liquid discharge, to the heat-generating body.

11. The method for discharging liquid according to claim 10, wherein, in the second liquid discharge and subsequent discharges in the consecutive discharge mode, a voltage pulse, with a width shorter than that of a voltage pulse applied to the heat-generating body in the first liquid discharge, is supplied to the heat-generating body.

* * * * *

UNITED STATES PATENT AND TRADEMARK OFFICE

CERTIFICATE OF CORRECTION

PATENT NO. : 6,505,903 B2 
DATED : January 14, 2003
INVENTOR(S) : Ishinaga et al.

It is certified that error appears in the above-identified patent and that said Letters Patent is hereby corrected as shown below:

Title page,
Item [57], ABSTRACT,
Line 3, "for" should read -- to --.
Line 4, "movable" should read -- movable member --.
Line 10, "Under" should read -- In --.
Line 15, "the" should read -- these --.
Line 17, "well" should read -- properly --.

Column 3,
Line 31, "is" should read -- in --.

Column 4,
Line 15, "above" should read -- above- --.
Line 17, "member. Taking" should read -- member, taking --.

Column 5,
Line 7, "above described" should read -- above-described --.

Column 7,
Line 17, "contacting" should read -- contacts --.
Line 28, "Moreover,. It" should read -- Moreover, it --.

Column 8,
Lines 1, 39 and 51, "above described" should read -- above-described --.
Line 16, "maintains" should read -- maintains a --.
Line 17, "toward" should be deleted and "or" should read -- or a --.
Line 18, "that" should read -- that the --.
Line 29, "to" should read -- on --.

Column 10,
Line 5, "single-doted" should read -- single-dotted --.

Column 11,
Lines 49 and 57, "above described" should read -- above-described --.

UNITED STATES PATENT AND TRADEMARK OFFICE

CERTIFICATE OF CORRECTION

PATENT NO. : 6,505,903 B2 
DATED : January 14, 2003
INVENTOR(S) : Ishinaga et al.

It is certified that error appears in the above-identified patent and that said Letters Patent is hereby corrected as shown below:

Column 13,
Lines 7, 19 and 64, "above described" should read -- above-described --.

Column 14,
Line 42, "in" should read -- (in --.
Line 63, "under" should read -- in --.

Signed and Sealed this

Twenty-eighth Day of October, 2003

JAMES E. ROGAN
*Director of the United States Patent and Trademark Office*